US005933677A

United States Patent [19]

Lee

[11] Patent Number: 5,933,677

[45] Date of Patent: Aug. 3, 1999

[54] METHOD FOR PROCESSING PAPER JAM ERROR IN IMAGE FORMING APPARATUS

[75] Inventor: Young-Seob Lee, Seoul, Rep. of Korea

[73] Assignee: SamSung Electronics Co., Ltd., Suwon, Rep. of Korea

[21] Appl. No.: 08/838,593

[22] Filed: Apr. 10, 1997

[30] Foreign Application Priority Data

Apr. 10, 1996 [KR] Rep. of Korea ..... 96-10826

[51] Int. Cl.[6] ..... G03G 15/00

[52] U.S. Cl. ..... 399/20; 399/19; 399/21

[58] Field of Search ..... 399/19–21, 81; 271/259

[56] References Cited

U.S. PATENT DOCUMENTS

| | | | |
|---|---|---|---|
| 4,231,567 | 11/1980 | Ziehm | 271/259 |
| 4,247,193 | 1/1981 | Kaneko et al. | 399/20 |
| 4,275,879 | 6/1981 | Yamashita et al. | 271/259 |
| 4,395,111 | 7/1983 | Takahashi et al. . | |
| 4,572,652 | 2/1986 | Tada et al. | 399/81 |
| 4,627,711 | 12/1986 | Schron | 399/20 |
| 4,786,041 | 11/1988 | Acquaviva et al. | 399/21 |
| 4,878,087 | 10/1989 | Sakai et al. . | |
| 4,878,428 | 11/1989 | Watarai . | |
| 4,970,599 | 11/1990 | Nobuta . | |
| 5,030,991 | 7/1991 | Zaitsu et al. . | |
| 5,058,879 | 10/1991 | Dunaway . | |
| 5,081,490 | 1/1992 | Wakao . | |
| 5,117,261 | 5/1992 | Sakai et al. . | |
| 5,311,254 | 5/1994 | Watanabe . | |
| 5,414,494 | 5/1995 | Aikens et al. | 399/1 |
| 5,459,553 | 10/1995 | Kim . | |
| 5,459,554 | 10/1995 | Shiraishi | 399/43 |
| 5,461,560 | 10/1995 | Lee . | |
| 5,502,545 | 3/1996 | Tsuruoka . | |
| 5,532,793 | 7/1996 | Kogure | 399/19 |
| 5,534,976 | 7/1996 | Kim . | |
| 5,678,138 | 10/1997 | Kobayashi et al. | 399/19 X |
| 5,761,567 | 6/1998 | Yoshizuka | 399/20 X |

FOREIGN PATENT DOCUMENTS

| | | |
|---|---|---|
| 0 303 267 A2 | 2/1989 | European Pat. Off. . |
| 62-058279 | 3/1987 | Japan . |
| 6-064786 | 3/1994 | Japan . |

*Primary Examiner*—Matthew S. Smith
*Attorney, Agent, or Firm*—Robert E. Bushnell, Esq.

[57] ABSTRACT

A method for processing a paper jam error in an image forming apparatus for performing successive image forming operations on successive sheets of paper using an electrophotographic developing process. The method includes determining when a paper jam occurs due to a paper feed failure of a current sheet of paper while the image forming apparatus performs successive image forming operations on successive sheets of paper; and when the paper jam occurs due to the paper feed failure of the current sheet of paper, completing an image forming operation of an immediately preceding sheet of paper, and then processing the paper jam which occurs due to the paper feed failure of the current sheet of paper.

15 Claims, 3 Drawing Sheets

METHOD FOR PROCESSING PAPER JAM ERROR IN IMAGE FORMING APPARATUS

CLAIM FOR PRIORITY

This application makes reference to, incorporates the same herein, and claims all benefits accruing under 35 U.S.C. §119 from an application for Method For Processing Paper Jam Error In Image Forming Device earlier filed in the Korean Industrial Property Office on Apr. 10, 1996 and there duly assigned Ser. No. 10826/1996.

BACKGROUND OF THE INVENTION

1. Technical Field

The present invention relates to an image forming apparatus using an electrophotographic developing process, and more particularly, relates to a method for processing paper jam error upon occurrence of paper jam in an image forming apparatus.

2. Related Art

Electrophotographic developing processes are widely used in computer printers, facsimile machines and photocopiers in order to produce images on recording media in response to video signals. A common example of an electrophotographic printing apparatus is a laser beam printer which prints images on individual sheets of paper through a series of electrostatic image-forming steps. Generally, the process of electrostatic image forming includes charging a photosensitive drum to a substantially uniform potential so as to sensitize the surface thereof. The charged portion of the photosensitive drum is exposed to a light image to record an electrostatic latent image on its surface. The latent image is then developed by applying toner from a developing unit onto the photosensitive drum which is subsequently transferred and fixed on a recording medium. When a toner image is fixed on a recording medium, the toner image is first heated and fused onto the recording medium, and then naturally cooled so that it is fixed onto the recording medium.

A significant problem that frequently occur in such an image forming apparatus is the "paper jam." Paper jams occur mainly due to paper feed failure, state damage of printing papers, jamming or sliding the papers in a specific portion of a paper conveyance path, and trouble of assemblies disposed in the paper conveyance path. Generally, when a paper jam error occurs, the image forming apparatus detects the paper jam error, and then processes the detected paper jam error by stopping the current printing operation and informing a user of occurrence of the paper jam error with visual message and an auditory message. Examples of conventional jam detection and recovery schemes are disclosed in U.S. Pat. No. 4,395,111 for Sheet Conveying Device issued to Takahashi et al., U.S. Pat No. 4,878,087 for Image Forming Apparatus With Jam Removal Mechanism issued to Sakai et al., U.S. Pat. No. 4,878,428 for Control Method Of Transporting A Cut Sheet In A Printing Station And An Apparatus Using The Same issued to Watarai, U.S. Pat. No. 4,970,599 for Image Processing Apparatus With Plural Page Memory And Error Detection issued to Nobuta, U.S. Pat. No. 5,030,991 for Jam Detection And Clearance System For Duplex Copiers issued to Zaitsu et al., U.S. Pat. No. 5,081,490 for Method Of Controlling Image Forming Apparatus When A Jam Occurs In The Original Feeder issued to Wakao, U.S. Pat. No. 5,117,261 for Image Forming Apparatus With Jam Recovery Function issued to Sakai et al., and U.S. Pat. No. 5,311,254 for Image Forming Apparatus Having Paper Jam Detecting System For The Automatic Document Handler issued to Watanabe.

Recent efforts to eliminate paper jams from an image forming device by employees of the assignee of this instant application are disclosed in U.S. Pat. No. 5,459,553 for Method For Eliminating A Paper Jam In An Image Forming System issued to Kim, U.S. Pat. No. 5,461,460 for Method For Eliminating A Paper Jam In An Image Forming System issued to Lee, and U.S. Pat. No. 5,534,976 for Method For Eliminating A Paper Jam Of An Image Forming System And Apparatus Therefor issued to Kim.

Paper jam error is generally classified with three categories depending on where the paper jam error is generated, e.g. the feeding and conveying of paper, or the transferring of paper, or the fixing and discharging of paper. A first error is generated upon feeding the paper, a second error is generated upon transferring the papers, and a third error is generated upon fixing and discharging the papers. Hereinafter, for the sake of clarity, the first error is referred to as "jam 0", the second error "jam 1", and the third error "jam 2". Among the paper jam errors, the jam "0" is generated by paper feed failure when the papers are not normally fed or conveyed from a paper cassette into an image forming device. Usually, the paper feed failure occurs when paper is not picked up from the paper cassette.

When jam "0" of the paper jam error is generated during consecutive printing operations, the image forming apparatus still performs the previous printing operation. In this situation, the typical image forming apparatus processes the paper jam error, and as a result, even the previous printing operation is interrupted. Here, the consecutive printing operations are performed and the previous printing paper is referred to as a paper preceding a paper to be fed currently. Typically, during the consecutive printing operations, the image forming apparatus feeds a next paper before the preceding paper is wholly discharged, so that in case of a jam "0", the printing operation on the previous printing paper can not be completed. Therefore, the user must reprint not only the paper where the paper jam error occurs but also the preceding paper before the current paper to be fed for the current image formation.

When paper becomes jammed due to a paper feed failure while the image forming apparatus performs the previous printing operation, it is my observation that the user must reprint the paper to be fed currently as well as the previously albeit defectively printed paper by immediately processing the generated paper jam error. This reprint requirement is not only undesirable but unnecessarily consumes papers.

SUMMARY OF THE INVENTION

Accordingly, it is therefore an object of the present invention to provide an image forming apparatus and process.

It is also an object to provide a method for processing a paper jam error when the paper jam error occurs due to a paper feed failure of a current sheet of paper while the image forming apparatus still performs an image forming operation on a preceding sheet of paper.

These and other objects of the present invention can be achieved by an image forming apparatus and a process of processing a paper jam error which includes the steps of: determining when a paper jam occurs due to a paper feed failure of a current sheet of paper while the image forming apparatus performs successive image forming operations on successive sheets of paper; and when the paper jam occurs due to the paper feed failure of the current sheet of paper, completing an image forming operation of an immediately preceding sheet of paper, and then clearing or otherwise processing the paper jam attributable to the paper feed failure of the current sheet of paper.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
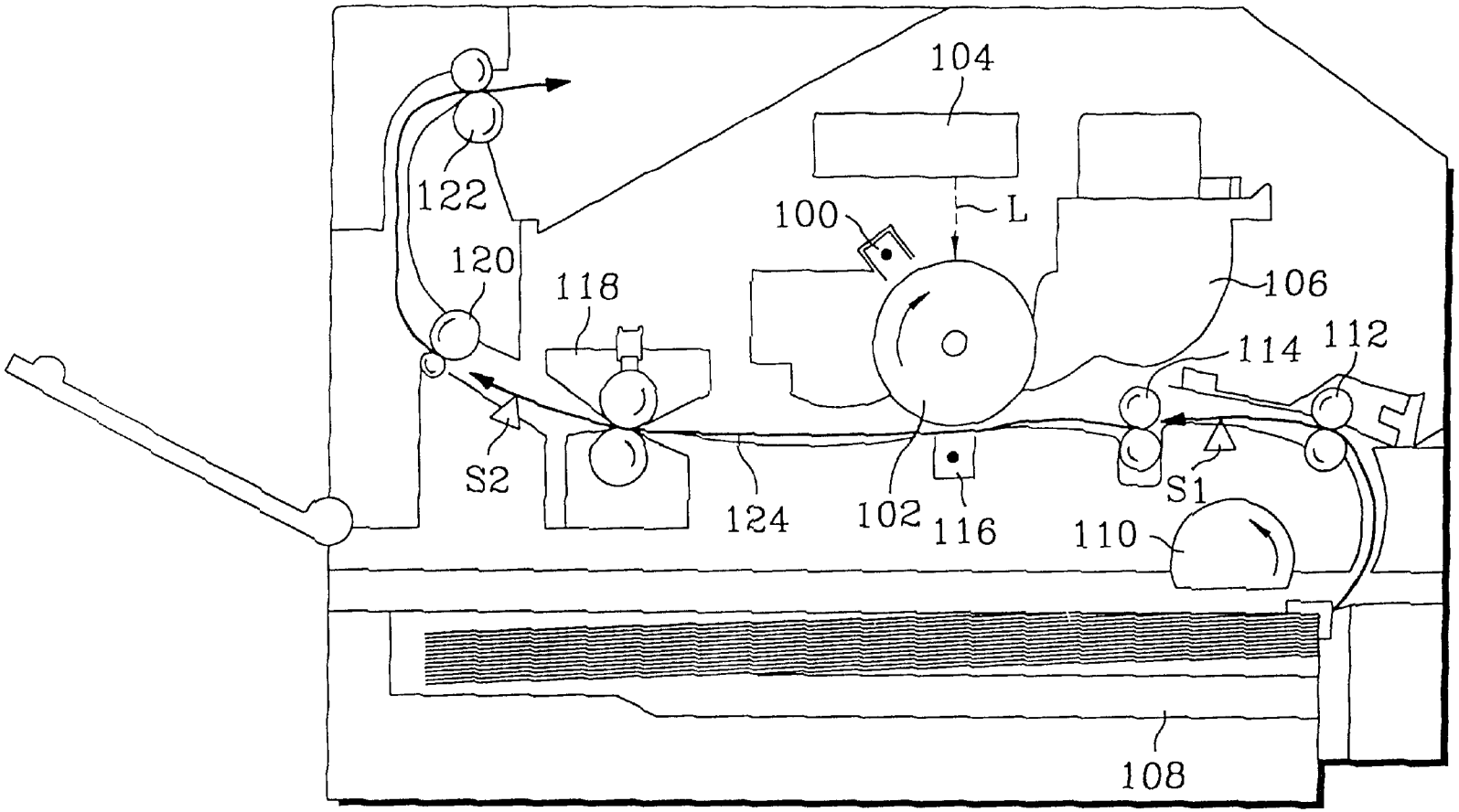
FIG. 1 illustrates an exemplary laser beam printer using an electrophotographic process.

Referring now to the drawings and particularly to FIG. 1, which illustrates an exemplary image forming apparatus such as a laser beam printer using an electrophotographic process. The laser beam printer includes a charging unit 100, a photosensitive drum 102, a laser scanner unit 104, a developing unit 106, a paper cassette 108, pick-up roller 110, a pair of conveying rollers 112, a pair of registration rollers 114, a transfer unit 116, a fixing unit 118 comprising a pair of coactive rollers which consists of a fuser roller and a pressure roller, and a pair of discharge rollers 120 and 122 for ejecting papers outside of the printer from a paper conveyance path 124.

As shown in FIG. 1, the charging unit 100, creates a uniform static electric charge on the outer surface of the photosensitive drum 102. The laser scanner unit 104 generates a laser beam L corresponding to a time-serial electrical pixel signal of image information input from an original image reading unit (not illustrated), and traces the image on the outer surface of photosensitive drum 102, so as to create a latent image on the surface of the photosensitive drum 102. The latent image is converted to a toner image by the developing unit 106.

The electrophotographic process begins when the pickup roller 110, picks up the uppermost sheet of paper S loaded in the paper cassette 108. The conveyor roller 112 conveys the paper to registration rollers 114, where the paper is aligned. A transfer charge is applied to the outer surface of the photosensitive drum 102 by the transfer unit 116, to transfer the toner image onto the paper. After toner image is transferred onto the paper, the cleaner (not shown) removes any residual toner on the surface of the photosensitive drum 102, and the fixing unit 118 fuses the toner image to the paper. The fixing unit 108 includes a fuser roller and a pressure roller. Fuser roller is heated by a heat lamp to fuse the toner image to the paper S.

The laser beam printer as shown in FIG. 1 also has sensors which monitor the operating state of the printer such as the paper conveyance state, the opening or the closing of the printer's cover. Sensors S1 to S2 are installed to monitor the paper conveyance state. The first sensor S1 is located in the paper path between conveyor roller 112 and registration rollers 114 to monitor the status of the paper that is transferred to registration rollers 114. The second sensor S2 is mounted in the paper conveyance path 124 between the fixing unit 118 and paper discharge rollers 120 and 122 to monitor the state of paper discharged to the output tray (not illustrated).

Figure 3:
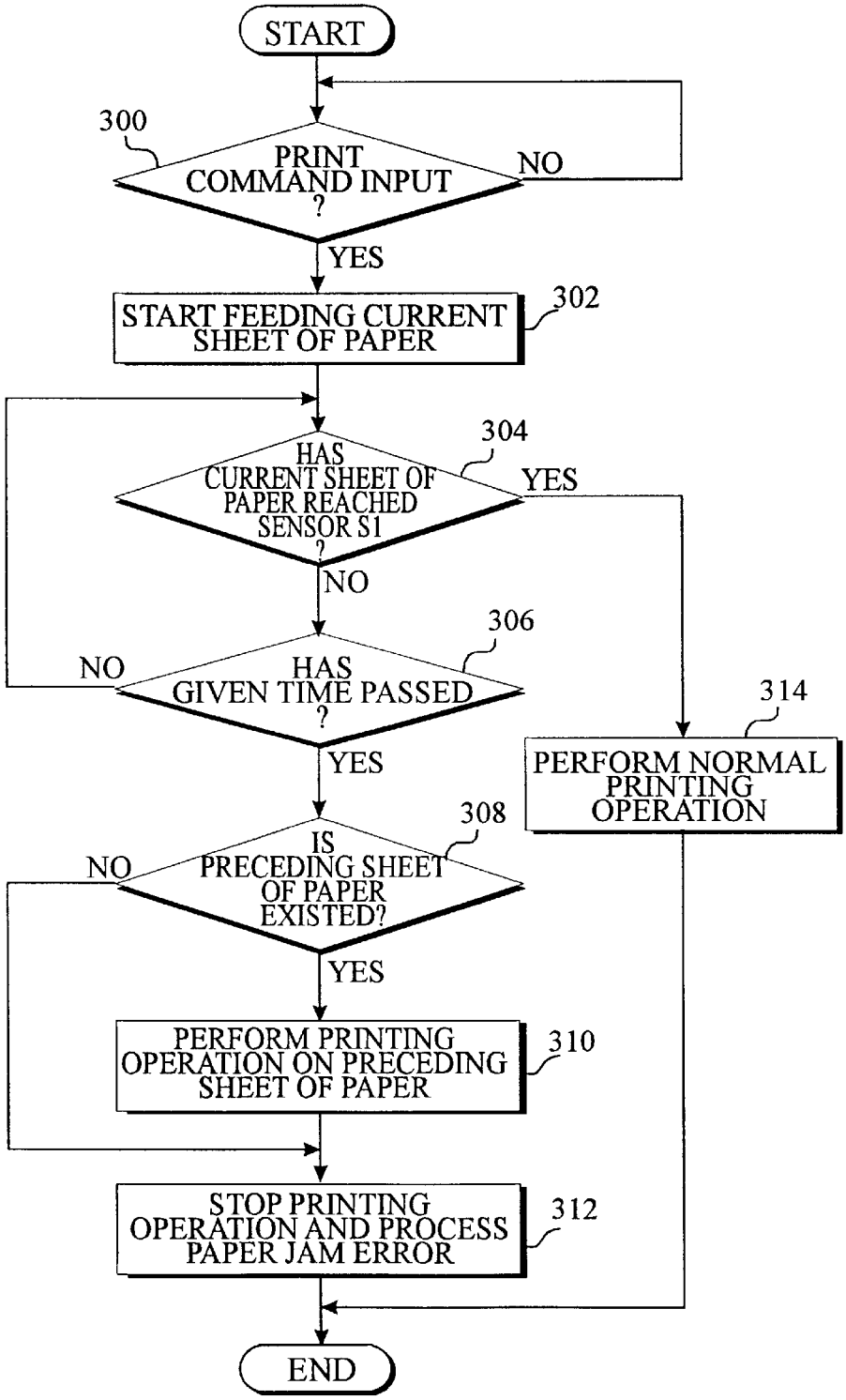
FIG. 3 is a flow chart illustrating steps of processing of a paper jam error according the present invention.

FIG. 3 is a block diagram of a laser beam printer using an electrophotographic process according to the principles of the present invention. The laser beam printer includes a video control unit 200, a print engine unit 204, and an operation panel OPE 202. Video control unit 200 includes a computer interface 206, an image processing unit 208, and an engine interface 210. Computer interface 206 is connected between a host computer and image processing unit 208 for transferring input/output signals.

Video control unit 200 converts data from computer interface 206 into image data so that it can be processed by printer engine unit 204. Image processing unit 208 includes a read-only-memory (ROM) containing a control program and a random-access-memory (RAM) for temporarily storing various data produced by the host computer and OPE 202. Image processing unit 208 converts input data received by computer interface 206 into image data which can be processed by printer engine unit 204 according to the operating program, and then sends the converted image data to the printer engine unit 204.

Engine interface 210, which is connected between image processing unit 208 and printer engine unit 204, transfers input/output (I/O) signals to and from printer engine unit 204 under the control of image processing unit 208. The OPE 202 is equipped with a set of input keys through which control commands that are sent to the printer, and a display unit for providing a visual display of status information during the printing operation, including a visual display of the paper jam when the paper jam error is generated.

Printer engine unit 204 includes a video interface 212, an engine controller 214, an input/output (I/O) interface 216, a sensor circuit 218, a mechanism driving unit 220, and an electrophotographic developing unit 222, and is connected to video control unit 200. Video interface 212 links video control unit 204 with engine controller 214. Under the control of image processing unit 208, engine controller 214 has control over the mechanism driving unit 220 and electrophographic developing unit 222, and prints images corresponding to the image data from video control unit 204.

The engine controller 214 monitors for operating failures which occur in the printer engine unit 204 such as paper feeding, paper conveyance, etc. with the sensor circuit 218. The I/O interface 216 is connected between the engine controller 214, the sensor circuit 218, the mechanism driving unit 220, and the electrophotographic developing unit 222 in order to link the engine controller 214 with the sensor circuit 218, the mechanism driving unit 220 and the electrophotographic developing unit 222. The sensor circuit 218 controls sensors which monitor the operating state of each of the components, the paper conveyance state, and the amount of toner, and transmits output signals of the sensors to engine controller 214. The mechanism driving unit 220 actuates various operating components of the laser beam printer used for paper feeding, paper conveyance, and printing operation. Developing unit 222 prints images under the control of engine controller 214.

Figure 2:
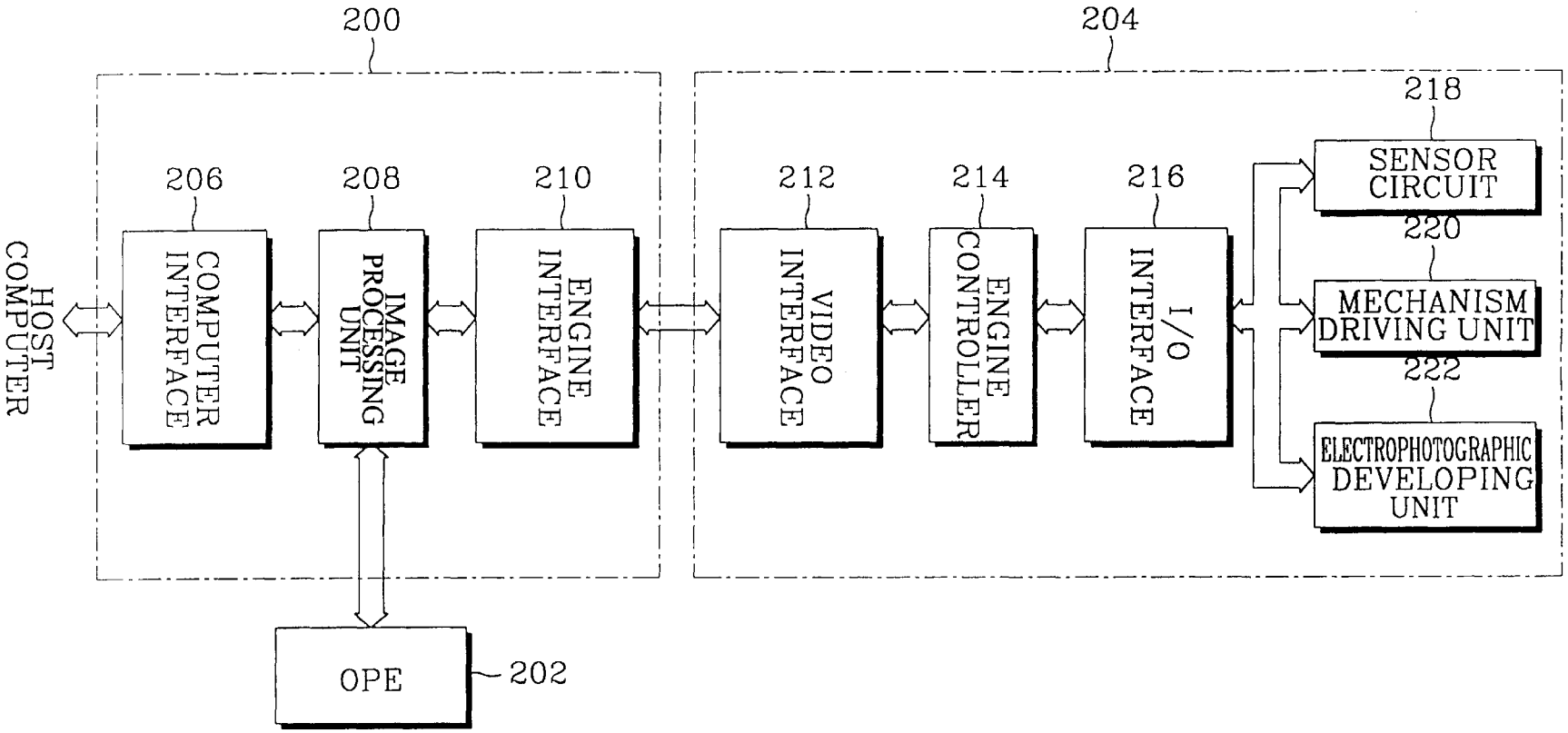
FIG. 2 is a block diagram of the exemplary laser beam printer.

In the laser beam printer as shown in FIGS. 1 and 2, upon printing operation, the engine controller 214 detects jam "0", jam "1", and jam "2" by the detection signals of the sensors S1 and S2. That is, although the printing papers are successively fed, the jam "0" is generated if a paper is not conveyed from the paper cassette 108 to the first sensor S1 within a given time. After that, if the paper is not ejected from the first sensor S1 or not conveyed or ejected to/from the second sensor S2, the engine controller 214 determines that the paper is abnormally conveyed in the printer. Then, either jam "1" or jam "2" is generated.

At this time, as mentioned previously, jam "0" is mostly generated each time the paper is not picked up from the paper cassette 108. Therefore, in case of generation of jam "0", if an engine driving motor (not shown) for driving various rollers of the printer as shown in FIG. 1 is continuously driven to perform consecutive printing operations, the previous printing operation is performed with no problem. Nevertheless, the printer stops performing even the printing operation of the preceding sheet of paper.

Therefore, in spite of occurrence of jam "1", the present invention contemplates the image forming apparatus to continuously perform the printing operation of the preceding sheet of paper and process the paper jam error after completing the previous printing operation. As a result, upon reprinting operation after eliminating the paper jam error, the user only has to reprint the current sheet of paper where the paper jam error is generated. Thus, the present invention advantageously provides the user operational convenience of the printer and efficiently prevent papers from being unnecessarily consumed.

Turning now to FIG. 3 which illustrates processing paper jam error according to the principles of the present invention. In the printer constructed as shown in FIGS. 1 and 2, if print data corresponding to a print signal is applied to the control unit 208 from the host computer during a standby mode, the control unit 208 transmits a print command to the print engine 204 and begins a printing operation at step 300. Then, the engine controller 214 starts feeding individual sheet of paper stacked in the paper cassette 108 in response to input of the print command at step 302. At this time, the engine controller 214 checks whether a paper is normally fed into the printer at steps 304 and 306. That is, the engine controller 214 determines whether the paper reaches to the first sensor S1 at step 304. When the paper reaches to the first sensor S1, the engine controller 214 performs normal printing operation and completes overall printing operations at step 314. However, when the paper does not reach to the first sensor S1, the engine controller 214 determines whether a given time has passed at step 306. At this moment, when the given time has passed and the paper still has not reached to the first sensor S1, the engine controller 214 determines whether a preceding sheet of paper is existed in the printer at step 308. However, when the given time has not passed at step 306, the engine controller 214 returns to step 304 to continue monitoring whether the paper has reached to the first sensor S1.

Meanwhile, when the engine controller 214 determines at step 308 that there is a preceding sheet of paper existed in the printer, the engine controller 214 performs the printing operation of the preceding sheet of paper at step 310, stops the printing operation of the current sheet of paper where paper jam is generated and processes the paper jam error at step 312. After that, the engine controller 214 ends all of the printing operations. However, when checked at step 308 that the preceding sheet of paper did not exist, the engine controller 214 proceeds to step 312, so that all of the printing operations can be stopped, thereby processing the paper jam error.

Therefore, when the paper jam error occurs due to the paper feed failure in the condition of performing the previous printing operation, the previous printing operation is continuously performed and completed, so that it is unnecessary to reprint the previous printing paper. Since unnecessary reprinting operation is prevented, the present invention is capable not only of providing the convenience to the user but also of preventing the consumption of the unnecessary papers.

While there have been illustrated and described what are considered to be preferred embodiments of the present invention, it will be understood by those skilled in the art that various changes and modifications may be made, and equivalents may be substituted for elements thereof without departing from the true scope of the present invention. Additionally, although the disclosed embodiment of the present invention is applied to a laser beam printer, however, can be also applied to various image forming devices using an electrophotographic developing system, such as copying machines, light emitting diode printer head LPH printers, plain paper facsimile systems, and etc. Accordingly, the scope of the present invention is not be defined solely by the disclosed embodiment, but rather by the scope of the appended claims and the equivalent thereof.

What is claimed is:

1. A method for processing a paper jam error in an image forming apparatus performing image forming operations on successive sheets of paper using an electrophotographic developing process, comprising the steps of:

determining when a paper jam occurs due to a paper feed failure of a current sheet of paper while said image forming apparatus performs single side image forming operations on successive sheets of paper; and when the paper jam occurs due to said paper feed failure of the current sheet of paper during performance of said single side image forming operations on successive sheets of paper, completing an image forming operation of an immediately preceding sheet of paper, and then clearing said paper jam attributable to said paper feed failure of the current sheet of paper.

2. The method of claim 1, further stopping said image forming operation and informing a user of occurrence of said paper jam.

3. The method of claim 2, further comprised of said informing the user of occurrence of said paper jam by way of a visual display through an operational panel.

4. The method of claim 2, further comprised of said informing the user of occurrence of said paper jam by way of an audible voice message.

5. A method for processing a paper jam error in a printer using an electrophotographic developing system, comprising the steps of:

(a) starting feeding individual sheet of recording media for a single side copy in response to input of a print command and determining whether each sheet of recording media is normally fed into the printer;

(b) when each sheet of recording media is normally fed into the printer, performing a single side copy operation on each sheet of recording media;

(c) when there is a paper feed failure as each sheet of recording media is being fed into the printer during performance of said single side copy operation on each sheet of recording media, determining whether there is a preceding sheet of recording media existed in the printer;

(d) when there is no preceding sheet of recording media in the printer, stopping all single side copy operations and processing said paper jam error; and (e) when there is said preceding sheet of recording media existed in the printer, completing said single side copy operation of said preceding sheet of recording media and then processing said paper jam error.

6. The method of claim 5, wherein said step (e) further comprises stopping said printing operation and informing a user of occurrence of said paper jam error.

7. The method of claim 6, further comprised of said informing the user of occurrence of said paper jam error by way of a visual display through an operational panel.

8. The method of claim 6, further comprised of said informing the user of occurrence of said paper jam error by way of an audible voice message.

9. The method of claim 6, wherein said step (a) comprises the steps of:

after feeding the current sheet of recording media, determining whether the current sheet of recording media is detected by a sensor during a predetermined time period;

when the current sheet of recording media is detected by said sensor during said predetermined time period, performing said single side copy operation on the current sheet of recording media; and when the current sheet of recording media is not detected by said sensor during said predetermined time period, determining that there is the paper feed failure.

10. The method of claim 9, wherein said paper jam error occurs due to the paper feed failure during consecutive copy operations on successive sheets of recording media.

11. An image forming apparatus for processing a paper jam while performing successive image forming operations on successive sheets of paper using an electrophotographic developing process, comprising:

a paper cassette for containing a stack paper;

a registration roller for registering each sheet of paper at a registration position for beginning an image forming operation;

a transfer unit for transferring a toner image on each sheet of paper during said image forming operation;

a fixing unit for fixing the toner image on each sheet of paper during said image forming operation;

a discharge roller for ejecting each sheet of paper from said image forming apparatus after the toner image is fixed on each sheet of paper;

a paper detector for detecting a presence of paper at said registration position as each sheet of paper is being conveyed into said registration position;

an operational panel including a keyboard having a plurality of discrete keys that are independently operable by manual depression to generate different control functions, and a display unit for providing a visual display of operation of the apparatus;

a controller for processing a paper jam error by:

starting feeding a current sheet of paper from said paper cassette in response to input of a print command from said keyboard, and determining whether the current sheet of paper is fed from said paper cassette and conveyed into said registration position;

when the current sheet of paper is conveyed into said registration position, performing said image forming operation on the current sheet of paper;

when the current sheet of paper is not conveyed into said registration position due to a paper feed failure, determining whether there is a preceding sheet of paper existed in one of said transfer unit and said fixing unit;

when there is no preceding sheet of paper existed in one of said transfer unit and said fixing unit, stopping all image forming operations and processing said paper jam error; and when there is said preceding sheet of paper existed in one of said transfer unit and said fixing unit, completing said image forming operation of said preceding sheet of paper and then processing said paper jam error.

12. The image forming apparatus of claim 11, further comprised of said controller stopping said image forming operation of the current sheet of paper and informing a user of occurrence of said paper jam error.

13. The image forming apparatus of claim 12, further comprised of said controller informing the user of occurrence of said paper jam error by way of a visual display through said display unit of said operational panel.

14. The image forming apparatus of claim 12, further comprised of said controller informing the user of occurrence of said paper jam error by way of an audible voice message.

15. The image forming apparatus of claim 12, further comprised of said controller comprising:

after feeding the current sheet of paper, determining whether the current sheet of paper is detected by said paper detector during a predetermined time period;

when the current sheet of paper is detected by said paper detector during said predetermined time period, performing normal image forming operation on the current sheet of paper; and when the current sheet of paper is not detected by said paper detector during said predetermined time period, determining that there is the paper feed failure.

* * * * *